US011652288B2

(12) United States Patent
Yang et al.

(10) Patent No.: US 11,652,288 B2
(45) Date of Patent: May 16, 2023

(54) ANTENNA

(71) Applicant: CommScope Technologies LLC, Hickory, NC (US)

(72) Inventors: Lei Yang, Suzhou (CN); Bin Ai, Suzhou (CN); Fusheng Lv, Suzhou (CN); Cheng Xue, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 144 days.

(21) Appl. No.: 17/233,897

(22) Filed: Apr. 19, 2021

(65) Prior Publication Data

US 2021/0359406 A1 Nov. 18, 2021

(30) Foreign Application Priority Data

May 18, 2020 (CN) ..... 202010417635.7

(51) Int. Cl.

| | |
|---|---|
| ***H01Q 1/52*** | (2006.01) |
| ***H01Q 19/10*** | (2006.01) |
| ***H01Q 21/06*** | (2006.01) |
| *H01Q 1/24* | (2006.01) |
| *H01Q 1/42* | (2006.01) |

(52) U.S. Cl.

CPC ..... *H01Q 1/521* (2013.01); *H01Q 1/52* (2013.01); *H01Q 19/10* (2013.01); *H01Q 21/06* (2013.01); *H01Q 1/246* (2013.01); *H01Q 1/42* (2013.01)

(58) Field of Classification Search

CPC ..... H01Q 1/521; H01Q 1/42; H01Q 19/10; H01Q 21/06; H01Q 1/52

USPC ..... 343/835

See application file for complete search history.

(56) References Cited

U.S. PATENT DOCUMENTS

| | | | | |
|---|---|---|---|---|
| 6,734,829 | B1 | 5/2004 | Göttl | |
| 2004/0263392 | A1* | 12/2004 | Bisiules | H01Q 1/246 343/700 MS |
| 2007/0146225 | A1* | 6/2007 | Boss | H01Q 21/26 343/797 |
| 2014/0139387 | A1* | 5/2014 | Jones | H01Q 21/30 343/794 |
| 2017/0125917 | A1* | 5/2017 | Lin | H01Q 9/16 |
| 2017/0346191 | A1* | 11/2017 | Farzaneh | H01Q 9/285 |

FOREIGN PATENT DOCUMENTS

| | | |
|---|---|---|
| CN | 205069883 U | 3/2016 |
| CN | 209183753 U | 7/2019 |

* cited by examiner

*Primary Examiner* — Hai V Tran
(74) *Attorney, Agent, or Firm* — Myers Bigel, P.A.

(57) ABSTRACT

Antennas comprise a reflector and first and second arrays of first radiating elements mounted on the reflector. The antenna further comprises a parasitic element including a metal ring, where the metal ring of the parasitic element is arranged between a first radiating element of the first array and a first radiating element of the second array. The antenna can improve the isolation between adjacent arrays, thereby improving the radiation patterns generated by the arrays.

20 Claims, 5 Drawing Sheets

ANTENNA

CROSS-REFERENCE TO RELATED APPLICATION

The present application claims priority to Chinese Patent Application No. 202010417635.7, filed May 18, 2020, the entire content of which is incorporated herein by reference as if set forth fully herein.

FIELD

The present invention relates to a communication system, and more particularly, to an antenna suitable for use in a communication system.

BACKGROUND

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station.

In many cases, each base station is divided into "sectors." In perhaps the most common configuration, a hexagonally shaped cell is divided into three 120° sectors, and each sector is served by one or more base station antennas that have an azimuth Half Power Beam width (HPBW) of approximately 65°. Typically, the base station antennas are mounted on a tower, with the radiation patterns (also referred to herein as "antenna beams") that are generated by the base station antennas directed outwardly. Base station antennas are often implemented as linear or planar phased arrays of radiating elements.

Parasitic elements are typically used in the base station antennas to tune the radiation pattern of the arrays of radiating elements to thereby improve the shape of the antenna beams that are formed by the arrays. A proper arrangement of the parasitic elements may enhance radiation in a desired direction and attenuate radiation in undesired directions. Further, as the number of the arrays of radiating elements mounted on the reflector of an antenna increases, the spacings between adjacent arrays are typically decreased, which results in increased coupling interference between the arrays. The increased coupling interference degrades the isolation performance of the radiating elements, which may negatively affect the performance the antenna. In order to improve the isolation performance, parasitic elements may be provided between adjacent radiating elements to improve the degree of isolation therebetween to thereby improve the radiation patterns of the base station antenna.

SUMMARY

According to a first aspect of the present invention, antennas are provided that comprises a reflector, first and second arrays of first radiating elements mounted on the reflector, and a parasitic element that includes a metal ring. The metal ring of the parasitic element is arranged between a first radiating element of the first array and a first radiating element of the second array.

The antennas according to the embodiments of the present invention may effectively improve the isolation between the first and second arrays, thereby improving the radiation patterns generated by the first and second arrays.

In some embodiments, arrays of first radiating elements are configured to generate first antenna beams in a first frequency band that includes at least a portion of a 1695-2690 MHz frequency band or a portion of a 3.1-4.2 GHz frequency band.

In some embodiments, a perimeter of the metal ring is between 80% and 120% of a reference wavelength, where the reference wavelength is equal to the wavelength corresponding to a reference frequency point in the first frequency band.

In some embodiments, the perimeter of the metal ring is an outer perimeter, an inner perimeter or an equivalent perimeter of the metal ring.

In some embodiments, the reference frequency point is a frequency point of an array of first radiating elements within the first frequency band with the worst degree of isolation, or the reference frequency point is set to be an average value of a plurality of frequency points of an array of first radiating elements within the first frequency band with worst degrees of isolation.

In some embodiments, the antenna array further comprises an array of second radiating elements, where the array of second radiating elements is configured to generate a second antenna beam in a second frequency band that includes at least a portion of the 694-960 MHz frequency band.

In some embodiments, the metal ring has an outer perimeter with at least 60%, or at least 80%, of the interior of the outer perimeter is free of metal.

In some embodiments, the metal ring is configured as a circular ring, a polygonal ring or an elliptical ring.

In some embodiments, the metal ring is configured as a closed ring.

In some embodiments, the metal ring is configured as an open ring with at least one slot.

In some embodiments, the metal ring is configured as a trace printed on a PCB board.

In some embodiments, the metal ring is constructed based on a magnetic dipole model, and the first radiating element is constructed based on an electric dipole model, such that the metal ring and the first radiating element have complementary characteristics in terms of radiation pattern, so as to at least partially compensate for the distortion of the radiation patterns of arrays of first radiating elements.

In some embodiments, the metal ring and the first radiating elements have complementary characteristics in terms of far field radiation pattern.

In some embodiments, the metal ring of the parasitic element extends farther from the reflector than the first radiating elements.

In some embodiments, the metal ring is configured to at least partially reduce the coupling interference to the first radiating element caused by reflections from a radome of the antenna.

According to a second aspect of the present invention, an antenna provided that comprises a reflector and first and second arrays of radiating elements mounted on the reflector, where each first radiating element is constructed based on an electric dipole model. The antenna further comprises a parasitic element, which is constructed based on a magnetic dipole model, so as to at least partially compensate for the distortion of the radiation pattern of the first array of first radiating elements.

In some embodiments, the parasitic element comprises a metal ring.

In some embodiments, the metal ring of the parasitic element acts an isolator arranged between a first radiating element of the first array and a first radiating element of the second array.

In some embodiments, the parasitic element and the array of first radiating elements have complementary characteristics in terms of far-field radiation pattern.

In some embodiments, the array of first radiating elements is configured to generate a first antenna beam in a first frequency band that includes at least a portion of a 1695-2690 MHz frequency band or a portion of a 3.1-4.2 GHz frequency band.

In some embodiments, the metal ring of the parasitic element extends farther from the reflector than the first radiating elements.

In some embodiments, the metal ring has an outer perimeter, and at least 80% of the interior of the outer perimeter is free of metal.

According to a third aspect of the present invention, there is an antenna provided. The antenna comprises a reflector, first and second arrays of radiating elements mounted on the reflector, and a parasitic element including a metal ring, where the metal ring has an outer perimeter with at least 50% of the interior of the outer perimeter free of metal.

In some embodiments, the metal ring of the parasitic element is arranged between a first radiating element of the first array and a first radiating element of the second array.

In some embodiments, the metal ring of the parasitic element extends farther from the reflector than the first radiating element of the first array and the first radiating element of the second array.

Figure 1:
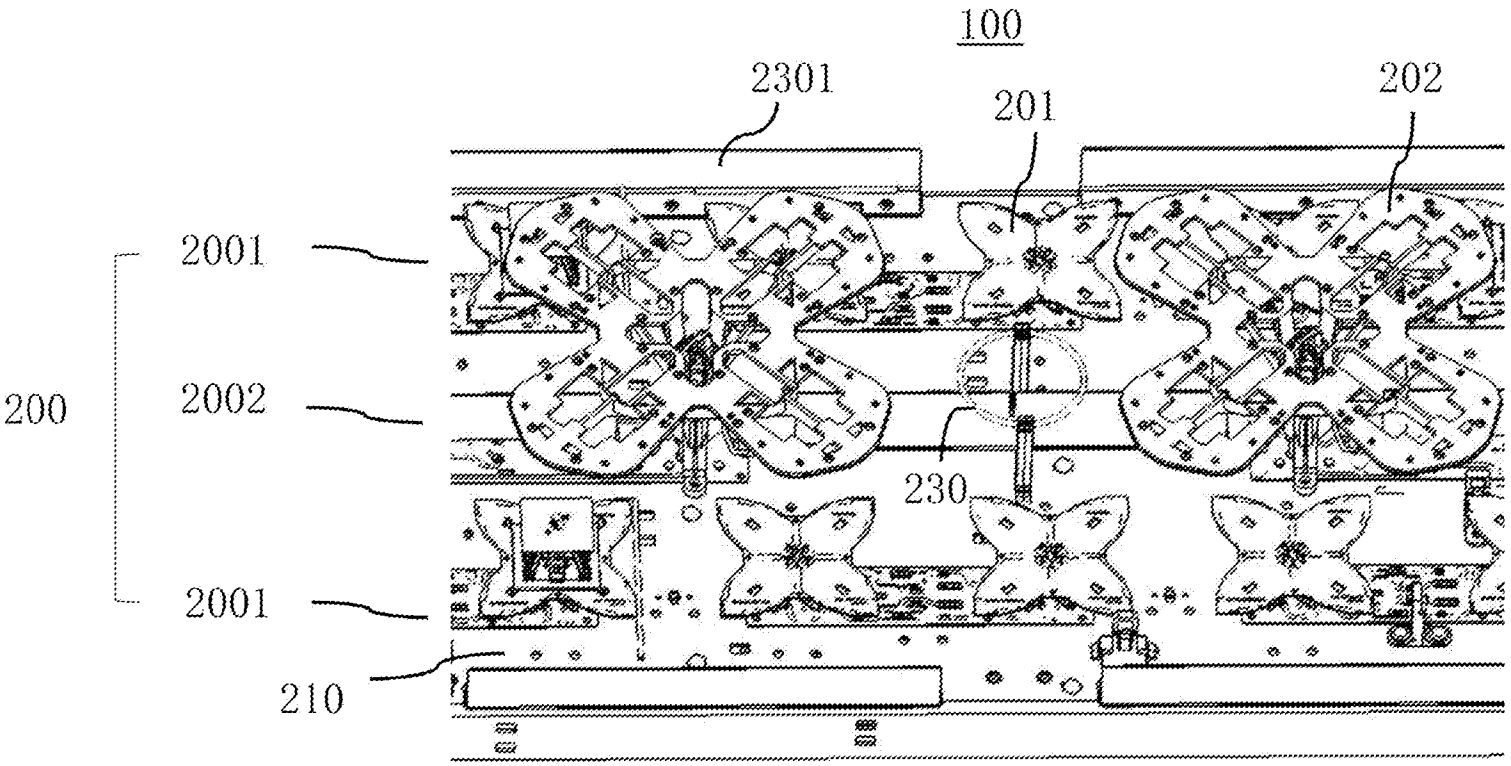
FIG. 1 is a schematic perspective view of a portion of an antenna according to some embodiments of the present invention.

In some cases the same elements or elements having similar functions are denoted by the same reference numerals in different drawings, and description of such elements is not repeated. In some cases, similar reference numerals and letters are used to refer to similar elements, and thus once an element is defined in one figure, it need not be further discussed for following figures.

In order to facilitate understanding, the position, size, range, or the like of each structure illustrated in the drawings may not be drawn to scale. Thus, the present invention is not necessarily limited to the position, size, range, or the like as disclosed in the drawings.

DETAILED DESCRIPTION

The present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the scope of the present invention to a person skilled in the art. The embodiments disclosed herein can be combined in various ways to provide many additional embodiments.

The wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

Herein, the foregoing description may refer to elements being "coupled" together. Unless expressly stated otherwise, "coupled" means that one element may be mechanically, electrically, logically or otherwise joined to another element in either a direct or indirect manner to permit interaction even though the two features may not be directly connected. That is, "coupled" is intended to encompass both direct and indirect joining of elements or other features, including connection with one or more intervening elements.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

The term "A or B" used through the specification refers to "A and B" and "A or B" rather than meaning that A and B are exclusive, unless otherwise specified.

The term "schematically" or "exemplary", as used herein, means "serving as an example, instance, or illustration", rather than as a "model" that would be exactly duplicated. Any implementation described herein as exemplary is not necessarily to be construed as preferred or advantageous over other implementations.

Herein, the term "substantially" is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

In this context, the term "at least a portion" may be a portion of any proportion, for example, may be greater than 10%, 20%, 30%, 40%, 50%, 60%, 70%, 80%, 90%, or even 100%.

In addition, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise/include", as used herein, specify the presence of stated features, steps, operations, elements, and/or components, but do not preclude the presence or addition of one or more other features, steps, operations, elements, components, and/or groups thereof.

Embodiments of the present invention will now be described in more detail with reference to the accompanying drawings.

Figure 2:
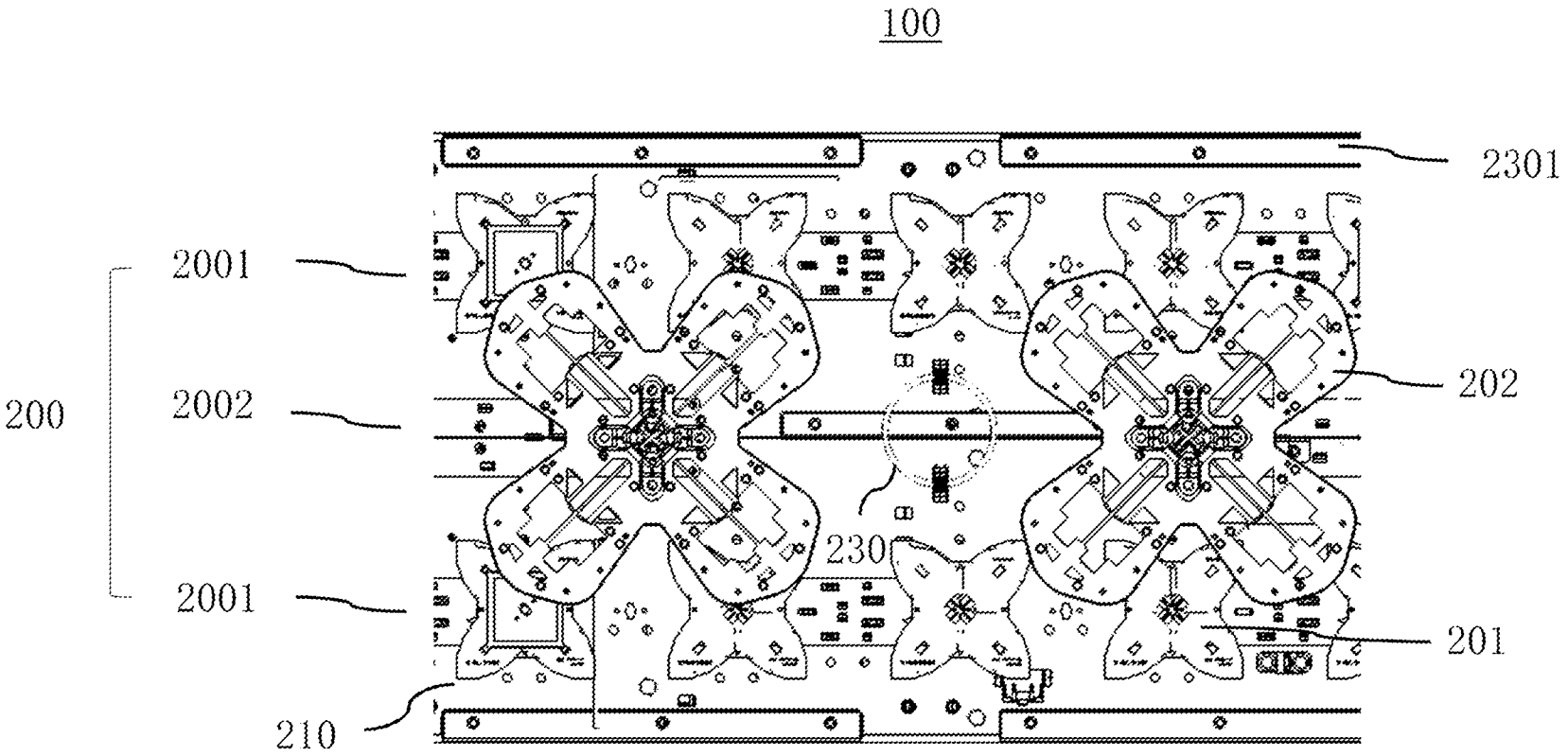
FIG. 2 is a schematic front view showing the portion of the antenna in FIG.
Figure 3:
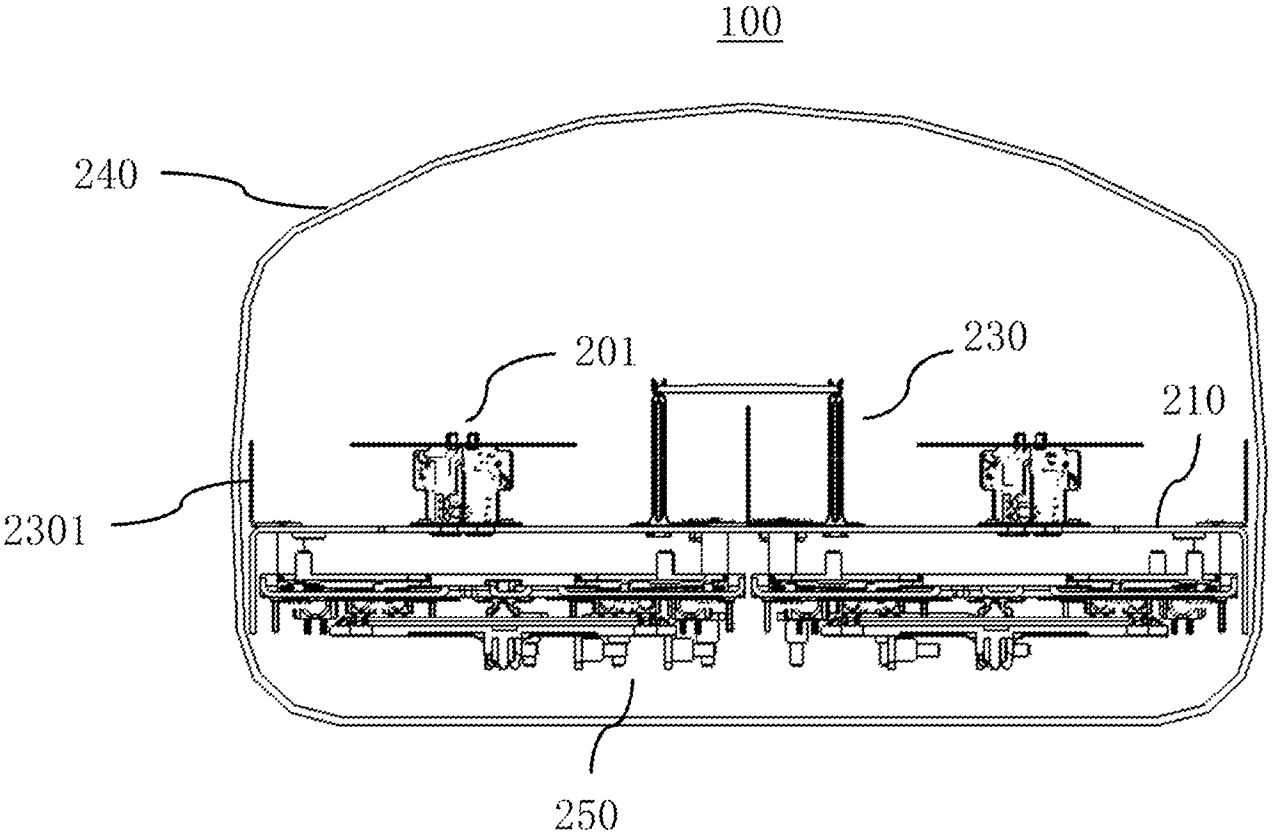
FIG. 3 is a schematic end view showing the portion of the antenna in FIG. 1.

FIG. 1 is a schematic perspective view showing a portion of an antenna 100 according to some embodiments of the present invention. FIG. 2 is a schematic front view showing the portion of the antenna 100 in FIG. 1. FIG. 3 is a schematic end view showing the portion of the antenna 100 in FIG. 1.

The antenna 100 may be mounted on a raised structure, such as antenna towers, utility poles, buildings, water towers and the like, with its longitudinal axis extending substantially perpendicular to the ground for convenient operation. The antenna 100 is usually mounted within a radome 240 (the radome is only shown in FIG. 3) that provides environmental protection. The antenna 100 includes a reflector 210. The reflector 210 may include a metal surface that provides a ground plane and reflects electromagnetic waves reaching it, for example, the metal surface redirects the electromagnetic waves for forward propagation. The antenna 100 further includes mechanical and electronic components 250, such as a connector, a cable, a phase shifter, a remote electronic tilt (RET) unit, a duplexer and the like, which are often disposed on a rear side of the reflector 210.

As shown in FIG. 1, the antenna 100 may further include an antenna array 200 disposed on a front side of the reflector 210. The antenna array 200 may include an array or arrays 2001 of first radiating elements 201 and an array or arrays 2002 of second radiating elements 202. In the current embodiment, the antenna 100 may be a multi-band antenna. The operating frequency band of the first radiating elements 201 may be, for example, V band (1695-2690 MHz) or sub-bands thereof (for example, H band (1695-2200 MHz), T band (2200-2690 MHz), or the like). The arrays 2001 of first radiating elements 201 may be configured to generate first antenna beams in the V band or a portion thereof. The operating frequency band of the second radiating elements 202 may be, for example, R band (694-960 MHz) or sub-bands thereof. The array 2002 of second radiating elements 202 may be configured to generate second antenna beams in the R band or a portion thereof.

In some embodiments, the antenna array 200 may further include an array or arrays of third radiating elements (not shown). The operating frequency band of the third radiating elements may be, for example, S band (3.1-4.2 GHz) or sub-bands thereof. The array(s) of third radiating elements may be configured to generate third antenna beams in the S band or a portion thereof. Although not shown in the figures, the antenna 100 may be configured as a so-called RVVSS multi-band antenna. That is, two arrays 2001 of first radiating elements 201, one array 2002 of second radiating elements 202 and two arrays of third radiating elements are provided.

It should be understood that the antenna 100 according to embodiments of the present invention may be any type of antennas (such as beamforming antennas) and is not limited to the current embodiment. For example, in some embodiments, the antenna array 200 may only include an array or arrays of first radiating elements 2001.

As the number of arrays of radiating elements mounted on a reflector 210 of a base station antenna 100 increases, the spacing between radiating elements of different arrays 200 typically decreases, which results in increased coupling interference between the arrays 200. This increased coupling interference may degrade the isolation (particularly the Co-polarization or "Co-pol" isolation) of the of radiating elements. The coupling interference between the arrays 200 may affect the radiation patterns in both the azimuth and elevation planes. Excessive coupling may affect not only the gain (due to coupling loss), but also may distort the shapes of the radiation patterns, thereby degrading the RF performance, such as the beamforming performance, of the antenna 100.

In order to improve the RF performance of the antenna 100, parasitic elements 230 for the antenna array 200 may be mounted on the reflector 210. The parasitic elements 230 may comprise, for example, conductive elements that are mounted forwardly of the reflector 210 and are adjacent to one or more of the radiating elements. The parasitic elements 230 may be configured to shape the radiation pattern of the one or more adjacent radiating elements. For example, parasitic elements 230 may be designed to narrow or widen the beamwidth of the radiation pattern(s) of the one or more adjacent radiating elements in the azimuth plane. The parasitic elements 230 may include fences 2301 that are placed around the antenna array 200 or between adjacent radiating elements. Some of the parasitic elements 230 may be positioned to act as isolators between adjacent radiating elements to increase the isolation and thereby reduce the coupling interference between the adjacent radiating elements. Other parasitic elements 230 may be placed around the antenna array 200 and may interact with the respective radiating elements. For example, in operation, the parasitic elements 230 may receive radio waves emitted by the respective radiating elements and then radiate the radio waves outward in different phases so as to adjust characteristics of the antenna beam of the antenna array 200, such as the beam width.

Pursuant to embodiments of the present invention, in order to improve the isolation between radiating elements in adjacent arrays and thereby improve the radiation patterns of the antenna array 200, a parasitic element 230 based on a magnetic dipole model is provided. Further, the parasitic element 230 based on the magnetic dipole model may interact with the radiating elements based on an electric dipole model to at least partially compensate for distortion of the radiation pattern of the antenna array 200 caused, for example, by radiating elements of another nearby array.

A magnetic dipole refers to a physical model established by analogy to the electric dipole. A system composed of two points of magnetic charges of equal magnitude and opposite polarity is called a magnetic dipole. At present, there is no single magnetic monopole, because the physical model of the magnetic dipole is a closed loop current, rather than two magnetic monopoles. A commonly used magnetic dipole model may be equivalent to a current loop. The electromagnetic properties of the current loop may be represented by an equivalent magnetic current and an equivalent magnetic charge similar to the current element. The direction of the equivalent magnetic current and the current direction of the current loop conform to the right-hand screw rule.

The electric dipole and the magnetic dipole may have good complementary characteristics in the radiation pattern, such as the far-field radiation pattern. For a horizontally arranged electric dipole, the far-field radiation pattern in the elevation plane may be approximately circular, and the far-field radiation pattern in the azimuth plane may be approximated to the shape of "8". For a vertically arranged magnetic dipole (in this case, the current loop is horizontally arranged), the far-field radiation pattern in the elevation plane may be approximated to the shape of "8", and the far-field radiation pattern in the azimuth plane may be approximately circular. Therefore, the selective combination of the electric dipole and the magnetic dipole may improve the symmetry and balance of the radiation pattern in the azimuth plane.

Based on the working principle of the magnetic dipole, the parasitic element 230 mounted on the reflector 210 may include a metal ring 231, thereby forming an equivalent current loop. As shown in FIGS. 1 to 3, the metal ring 231 of the parasitic element 230 may be arranged between adjacent radiating elements (for example, adjacent first radiating elements 201) to function as an isolator for reducing the coupling interference between the adjacent radiating elements.

Figure 4:
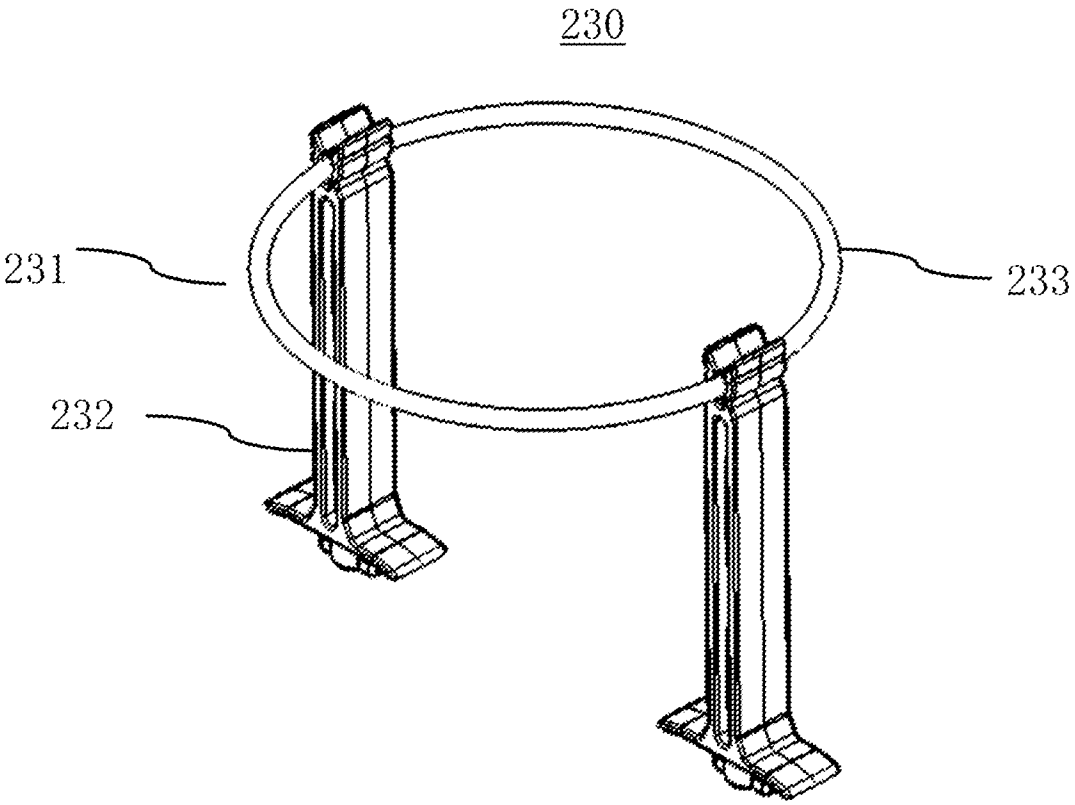
FIG. 4 is an enlarged schematic view of a parasitic element mounted within the antenna in FIG. 1.

FIG. 4 is an enlarged schematic view of a parasitic element 230 according to embodiments of the present invention that functions as an isolator. The parasitic element 230 may include a support leg 232 and a metal ring 231 mounted on the support leg 232. The support leg 232 is mounted on the reflector 210. The metal ring 231 may be a metal structure or a sheet metal part, such as a copper ring, an aluminum ring or an alloy ring. In some embodiments, the support leg 232 may be made of a non-conductive material, such as plastic, so that the metal ring 231 may be electrically floating. In some embodiments, the support leg 232 may be made of metal material, so that the metal ring 231 may be galvanically (or alternatively, capacitively) coupled to the reflector 210. Further, the parasitic element 230 may be mounted on the reflector 210 by means of bayonet connection, screw connection, rivet connection, welding, and/or bonding, for example.

The parasitic element 230 with a metal ring 231 may be cost-effective; second, may be of any desired thickness; and may have a low level of surface roughness and exhibit improved passive intermodulation ("PIM") distortion performance.

However, the metal ring 231 may also be configured as a trace ring printed on a printed circuit board. The parasitic element 230 with a PCB-based metal ring 231 may also be advantageous, because it is easy to print various conductive sections on a printed circuit board, and the implementation of the conductive sections is flexible and diverse so that the conductive sections can be better adapted to the actual application situation.

It should be understood that the metal ring 231 may be configured as a ring structure of various shapes, such as a circular ring, a polygonal ring, an elliptical ring, or the like. The ring may also include both curved and straight segments. The specific shape of the metal ring 231 is not limited in this application.

In some embodiments, the metal ring 231 may be configured as a closed ring. In other words, the metal ring 231 has a continuous conductive path. In other embodiments, the metal ring 231 may also be configured as an open ring with a slot. In other words, the metal ring 231 has an intermittent conductive path. For example, when the metal ring 231 is configured as a trace ring printed on a printed circuit board, it is relatively easy and efficient to provide a slot on the metal ring 231.

It should be understood that the metal ring 231 may be understood as a metal structure having a metal-free region inside. In some embodiments, the metal ring 231 may have an outer perimeter 233 with at least 20%, 30%, 40%, 50%, 60%, 70%, 80%, 90% or 95% of the interior of the outer perimeter free of metal. The RF performance of the metal ring 231 may be related to the perimeter (outer perimeter, inner perimeter or equivalent perimeter) of the metal ring 231, particularly to the inner perimeter of metal ring 231. When designing the perimeter of the metal ring 231, a reference frequency point may be selected so that the perimeter of the metal ring 231 is substantially equal to the reference wavelength corresponding to the reference frequency point. For example, the perimeter of the metal ring 231 of the parasitic element 230 may be between 80% and 120% of the reference wavelength.

Figure 5:
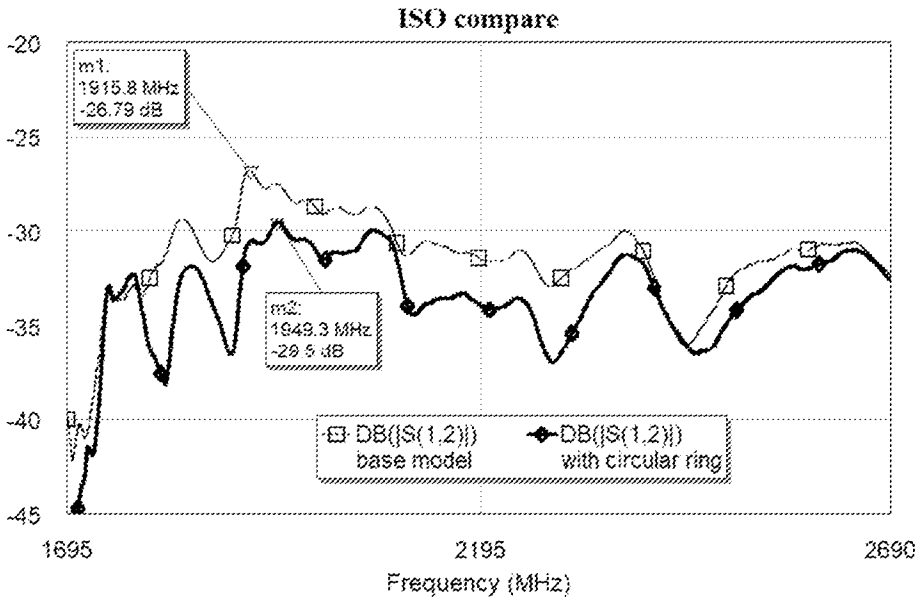
FIG. 5 is shows a comparison diagram of the inter-band isolation of the antenna of FIG. 1 with and without the parasitic element of FIG. 4.

Further, when designing the metal ring 231, the RF performance, such as the degree of isolation (inter-band isolation and/or intra-band isolation) at some frequency points, of the radiating element (such as the first radiating element 201) within its operating frequency band may be firstly considered. Then, a frequency point with the worst isolation or several frequency points with poor isolation is/are selected. The selected frequency point itself or a frequency point obtained by numerically processing (such as filtering and/or averaging) of the selected several frequency points may be selected as the final reference frequency point. With the parasitic element 230 according to some embodiments of the present invention, the isolation degree (such as the inter-band isolation) of the radiating element within its operating frequency band may be advantageously kept at a good level, for example, below −28 dB. As shown in FIG. 5, the dotted line exemplarily shows a characteristic curve of an inter-band isolation of an antenna without a parasitic element according to some embodiments of the present invention, while the solid line exemplarily shows a characteristic curve of an inter-band isolation of an antenna with a parasitic element according to some embodiments of the present invention. It can be seen that the operating frequency band of the array of radiating elements includes 1695 MHz to 2690 MHz. Within this operating frequency band, the worst inter-band isolation degree of the antenna is located at the frequency point of 1915.8 MHz, and by means of the parasitic element of present invention can effectively improve the inter-band isolation in this worst case from −26.79 to −29.5 dB. It should be understood that in order to obtain a higher isolation, more parasitic elements can be installed appropriately.

In some embodiments, the metal ring 231 of the parasitic element 230 can not only effectively reduce the coupling interference between adjacent radiating elements, but also effectively reduce the coupling interference caused by the reflection of the radome 240. The coupling interference caused by the reflection of the radome 240 is related to the arched configuration of the radome 240 itself, the short distance between the radiating element and the radome 240, and/or the operating frequency band of the radiating element. In order to at least partially reduce the coupling interference caused by the reflection of the radome 240, the metal ring 231 of the parasitic element 230 may extend further from the reflector 210 than the first radiating element 201 (refer to FIG. 3). In other words, the metal ring 231 may be located forwardly of the adjacent first radiating elements 201, so that the RF signal reflected by the radome 240 may be first absorbed by the metal ring 231, and then re-radiated outwards with different phases and some extent of attenuation, thereby reducing coupling interference to the radiating element caused by the reflection of the radome 240.

It should be understood that the specific arrangement of the parasitic element 230 is not limited in this application. In some embodiments, the parasitic element 230 with the metal ring 231 may also be arranged at other positions, for example, around the antenna array 200. In some embodiments, the first radiating element 201 may extend farther to the front of the reflector 210 than the metal ring 231 of the parasitic element 230.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

That which is claimed is:

1. An antenna comprising:

a reflector;

first and second arrays of first radiating elements mounted on the reflector, the first and second arrays of first radiating elements extending in length in a first direction and spaced apart from each other in a second direction that crosses the first direction; and a parasitic element including a metal ring, wherein the metal ring of the parasitic element is arranged in the second direction between a first radiating element of the first array and a first radiating element of the second array.

2. The antenna according to claim 1, wherein the first and second arrays of first radiating elements are configured to generate first antenna beams in a first frequency band that includes at least a portion of a 1695-2690 MHz frequency band or a portion of a 3.1-4.2 GHz frequency band.

3. The antenna according to claim 2, wherein a perimeter of the metal ring of the parasitic element is between 80% and 120% of a reference wavelength, wherein the reference wavelength is equal to the wavelength corresponding to a reference frequency point in the first frequency band.

4. The antenna according to claim 3, wherein the perimeter of the metal ring is an outer perimeter, an inner perimeter or an equivalent perimeter of the metal ring.

5. The antenna according to claim 3, wherein the reference frequency point is a frequency point elements within the first frequency band where one of the first and second arrays of first radiating has a worst degree of isolation, or the reference frequency point is an average value of a plurality of frequency points elements within the first frequency band where one of the first and second arrays of first radiating elements have worst degrees of isolation.

6. The antenna according to claim 2, wherein the antenna further comprises an array of second radiating elements, wherein the array of second radiating elements is configured to generate a second antenna beam in a second frequency band that includes at least a portion of a 694-960 MHz frequency band.

7. The antenna according to claim 1, wherein the metal ring has an outer perimeter with at least 60% of an interior of the outer perimeter free of metal.

8. The antenna according to claim 1, wherein the metal ring is configured as a circular ring, a polygonal ring or an elliptical ring.

9. The antenna according to claim 1, wherein the metal ring is configured as a closed ring.

10. The antenna according to claim 1, wherein the metal ring is configured as an open ring with at least one slot.

11. The antenna according to claim 1, wherein the metal ring and the first radiating element have complementary characteristics in terms of radiation pattern, so as to at least partially compensate for distortion of radiation patterns of the first and second arrays of first radiating elements.

12. The antenna according to claim 1, wherein the metal ring and the first radiating elements have complementary characteristics in terms of far field radiation pattern.

13. The antenna according to claim 1, wherein the metal ring of the parasitic element extends farther from the reflector than the first radiating elements.

14. The antenna according to claim 13, wherein the metal ring is configured to at least partially reduce a coupling interference to the first radiating elements caused by a reflection of a radome of the antenna.

15. An antenna comprising:

a reflector;

first and second arrays of radiating elements mounted on the reflector, the first and second arrays extending in length in a first direction and spaced apart in a second direction that crosses the first direction; and a parasitic element including a metal ring between the first and second arrays of radiating elements in the second direction, wherein the metal ring has an outer perimeter with at least 50% of an interior of the outer perimeter free of metal.

16. The antenna according to claim 15, wherein the metal ring of the parasitic element is arranged in the second direction between a first radiating element of the first array and a first radiating element of the second array.

17. The antenna according to claim 16, wherein the metal ring of the parasitic element extends farther from the reflector than the first radiating element of the first array and the first radiating element of the second array.

18. The antenna according to claim 15, wherein a perimeter of the metal ring of the parasitic element is between 80% and 120% of a reference wavelength, wherein the reference wavelength is equal to the wavelength corresponding to a reference frequency point in a first operating frequency band of the radiating elements.

19. The antenna according to claim 15, wherein the metal ring is configured as a circular ring, a polygonal ring or an elliptical ring.

20. The antenna according to claim 15, wherein the metal ring and the radiating elements have complementary characteristics in terms of far field radiation pattern.

* * * * *